US005115737A

United States Patent [19]

Amendola

[11] Patent Number: 5,115,737

[45] Date of Patent: May 26, 1992

[54] HOT ROTARY STAMPER APPARATUS AND METHODS FOR METAL LEAF STAMPING

[75] Inventor: Angel Amendola, Millersville, Md.

[73] Assignee: Philip Morris Incorporated, New York, N.Y.

[21] Appl. No.: 509,167

[22] Filed: Apr. 16, 1990

[51] Int. Cl.[5] ..... B31F 1/07

[52] U.S. Cl. ..... 101/32; 101/228; 101/25; 101/21; 101/23

[58] Field of Search ..... 101/8, 9, 11, 21, 27, 101/31, 32, 25, DIG. 31, 5, 6, 228, 336, 23

[56] References Cited

U.S. PATENT DOCUMENTS

| | | | |
|---|---|---|---|
| 2,758,541 | 8/1956 | Tison | 101/228 |
| 3,606,836 | 9/1971 | Colwill | 101/244 |
| 3,648,604 | 3/1972 | Warsager | 101/181 |
| 3,861,512 | 1/1975 | Coriasco et al. | 101/21 |
| 4,048,913 | 9/1977 | Naui | 101/27 |
| 4,063,500 | 12/1977 | Abe | 101/27 |
| 4,372,206 | 2/1983 | Tison et al. | 101/228 |
| 4,475,457 | 10/1984 | Davidson | 101/228 |
| 4,682,540 | 7/1987 | Eastman et al. | 101/32 |

FOREIGN PATENT DOCUMENTS

| | | |
|---|---|---|
| 49-14891 | 8/1974 | Japan . |
| 2150886 | 7/1985 | United Kingdom . |

*Primary Examiner*—Edgar S. Burr
*Assistant Examiner*—Christopher A. Bennett
*Attorney, Agent, or Firm*—Eric R. Hubbard

[57] ABSTRACT

A continuous sheet of metal leaf advanced at a constant rate is moved at variable velocity through a rotary die stamper such that between stamps the metal leaf moves at a velocity which is slower than the velocity of a substrate web; but just prior to stamping the metal leaf is accelerated by contact between the metal leaf and a raised die rotating at the velocity of the substrate web so that when the stamp occurs the metal leaf is traveling at a velocity substantially equal to the velocity of the substrate web. Varying the velocity of the metal leaf has the effect of minimizing the distance the metal leaf travels between stamps which conserves consumption of the metal leaf. Separate means for accelerating the leaf prior to stamping and decelerating the leaf after stamping also may be provided.

24 Claims, 7 Drawing Sheets

HOT ROTARY STAMPER APPARATUS AND METHODS FOR METAL LEAF STAMPING

BACKGROUND OF THE INVENTION

This invention relates to stamping designs from a continuous metal leaf onto a continuous moving substrate web with minimum waste of leaf, more particularly, to in-line hot stamping of metal leaf in an in-line gravure ink printing machine.

Methods for stamping a metal leaf on packaging material are well known. A hot rotary stamper utilizes a die mounted on a rotating roller to accomplish the transfer of material onto a substrate using pressure, elevated temperature, and time. Hot rotary stamping is particularly well suited for continuous stamping processes.

Metal leafs may be stamped onto substrate webs used in the packaging industry. The application of metal leaf is desired because it is more reflective than inks and is preferred for marketing and aesthetic reasons.

Hot stamping of packaging material has been traditionally carried out in a two step process. The first step is printing of the substrate material with the desired decorative design on an in-line printing machine during continuous advance of the substrate. The second step is to perform the hot stamping of metal leaf on discrete sheets of substrate while held stationary in a hot stamping press. Thereafter, the stamped sheets may be subjected to a third step whereby the stamped portions may be printed with inks.

One of the problems with the known hot stamping techniques is to make efficient use of the metal leaf which is a relatively expensive component of the packaging materials. Sheet stamping provides for efficient use by minimizing the amount of waste, but involves an additional expense of a separate stamping station and the time required to perform the stamping operation.

Techniques for continuously advancing the leaf at the same speed as the substrate for in-line stamping are known but they involve an unacceptable waste of leaf between stamping locations. Such techniques include making a stamp by superpositioning a metal leaf and a substrate web, moving at the same velocity, between a die roller having one or more raised dies and a back-up roller rotating at the same velocity as the metal leaf and the substrate web. The stamp is made at the point where a raised die forces the metal leaf and the substrate web against the backup roller with sufficient force to transfer the metal leaf to the substrate web. These techniques provide that this point is where a raised die is aligned with the centers of the die roller and the back-up roller.

It is therefore, an object of this invention to provide an improved apparatus and method for advancing thin metal leaf at a variable velocity for stamping metal leaf on a moving substrate and con serving metal leaf.

It is another object to use the stamping mechanism itself to accelerate the leaf to the speed of the substrate necessary for stamping.

It is a further object of this invention to provide a means for accelerating and decelerating the metal leaf which is electronically controlled.

It is a further object of this invention to provide for unevenly spacing the stamps in a repeating pattern on the substrate web.

It is a further object of this invention to provide an improved apparatus for advancing thin metal leaf at variable speed with a heated die.

It is a further object of this invention to provide an improved apparatus and method for hot rotary stamping of metal leaf which may be combined with in-line gravure ink printing.

SUMMARY OF THE INVENTION

The present invention provides for an apparatus and method for moving a continuous sheet of metal leaf at variable velocity through a rotary die stamper such that when a stamping location is reached, the metal leaf has been accelerated to a first velocity from a second velocity. The first velocity being substantially equal to the velocity of the substrate web, and substantially faster than the second velocity which is the velocity at which the metal leaf moves prior to stamping. Acceleration from the second velocity to the first velocity may be the result of contact between the metal leaf and a raised die rotating at the velocity of the substrate web. Varying the velocity of the metal leaf has the effect of minimizing the distance the metal leaf travels between stamps which conserves metal leaf.

The apparatus of the invention includes a die roller having a raised die including a design to be stamped on an advancing substrate. A back-up roller is mounted in opposition to the die roller so that the metal leaf and substrate may be freely passed between the die roller and the back-up roller when the raised die is not in contact with the metal leaf and so that when the raised die contacts the metal leaf it will urge the metal leaf against the substrate web and the back-up roller to transfer to the substrate metal leaf in accordance with the die design.

The apparatus of the invention also includes first means for feeding the metal leaf between the die roller and the backup roller at a variable velocity between the second velocity and the first velocity having an average velocity equal to a third velocity, the second velocity being slower than the first velocity; second means for feeding the metal leaf at the third velocity which is equal to the average velocity of the metal leaf passing between the die roller and the back-up roller; and means for rotating the die roller and the back-up roller at the first velocity.

In a preferred embodiment, the first means for feeding may be a low inertia dancer including a roller. The low inertia dancer is positioned upstream from the die roller and is capable of movement between a first position for allowing the metal leaf a greater distance of travel from the second means for feeding to the raised die and a second position for allowing a lesser distance of travel from the second means for feeding to the raised die. Acceleration of the metal leaf from the second velocity to the first velocity causes the low inertia dancer roller to move from the first position to the second position. When the raised die moves out of contact with the metal leaf, the low inertia dancer returns to the first position, decelerating the metal leaf. The low inertia dancer thereby allows the second means for feeding the metal leaf to operate at the third velocity regardless of any acceleration or deceleration downstream of the dancer.

In another preferred embodiment of the apparatus of the invention the die roller may have more than one raised die which may be evenly or unevenly spaced apart.

Another preferred embodiment of the apparatus of the invention includes a second means for feeding which is a pinch roller rotated at the third velocity.

Another preferred embodiment of the apparatus of the invention includes a means for accelerating and decelerating the metal leaf between the first velocity and the second velocity, and which is located downstream from the second means for feeding. The metal leaf is accelerated just before the raised die contacts the metal leaf and is decelerated just after the die design has been transferred to the substrate and the raised die has moved out of contact with the metal leaf.

Optionally, the means for accelerating and decelerating the metal leaf may be a drivable pinch roller and associated capstan.

In a preferred embodiment, the apparatus may include a microprocessor means for controlling the means for accelerating and decelerating to accelerate or decelerate the metal leaf and means for detecting of the position of the raised die relative to the location where the metal leaf in the design is transferred to the substrate. Such detection may occur, for example, by photoelectrically detecting a mark or by monitoring the angular position of the die roller using conventional means.

The method of the present invention includes stamping metal leaf designs from a continuous sheet of metal leaf onto a continuous sheet of substrate at a stamping location by passing the substrate at a first velocity in a first direction between a back-up roller and a die roller having a raised die including a design thereon; passing the metal leaf moving at a second velocity, in superposition to the substrate and between the die roller and backup roller, said first velocity being faster than said second velocity; rotating the back-up roller and the die roller at the first velocity; accelerating the metal leaf from the second velocity to the first velocity by contacting the metal leaf with the rotating raised die; absorbing the forces exerted on the metal leaf during acceleration of the metal leaf; and urging the raised die in contact with the metal leaf against the substrate web and the backup roller to stamp the design onto the substrate at the stamping location.

In a preferred embodiment of the method of the invention, the stamps may be made in an evenly or unevenly spaced repeating pattern on the substrate web.

A preferred embodiment of the method of the invention provides for accelerating the metal leaf between the second velocity and the first velocity just before the metal leaf is contacted by the raised die and decelerating the metal leaf from first velocity to the second velocity when the raised die moves out of contact with the substrate web.

BRIEF DESCRIPTION OF THE DRAWINGS

The above and other objects and advantages of the invention will be apparent on consideration of the following detailed description, taken in conjunction with the accompanying drawings, in which like reference characters refer to like parts throughout, and in which.

DETAILED DESCRIPTION OF THE INVENTION

Figure 1:
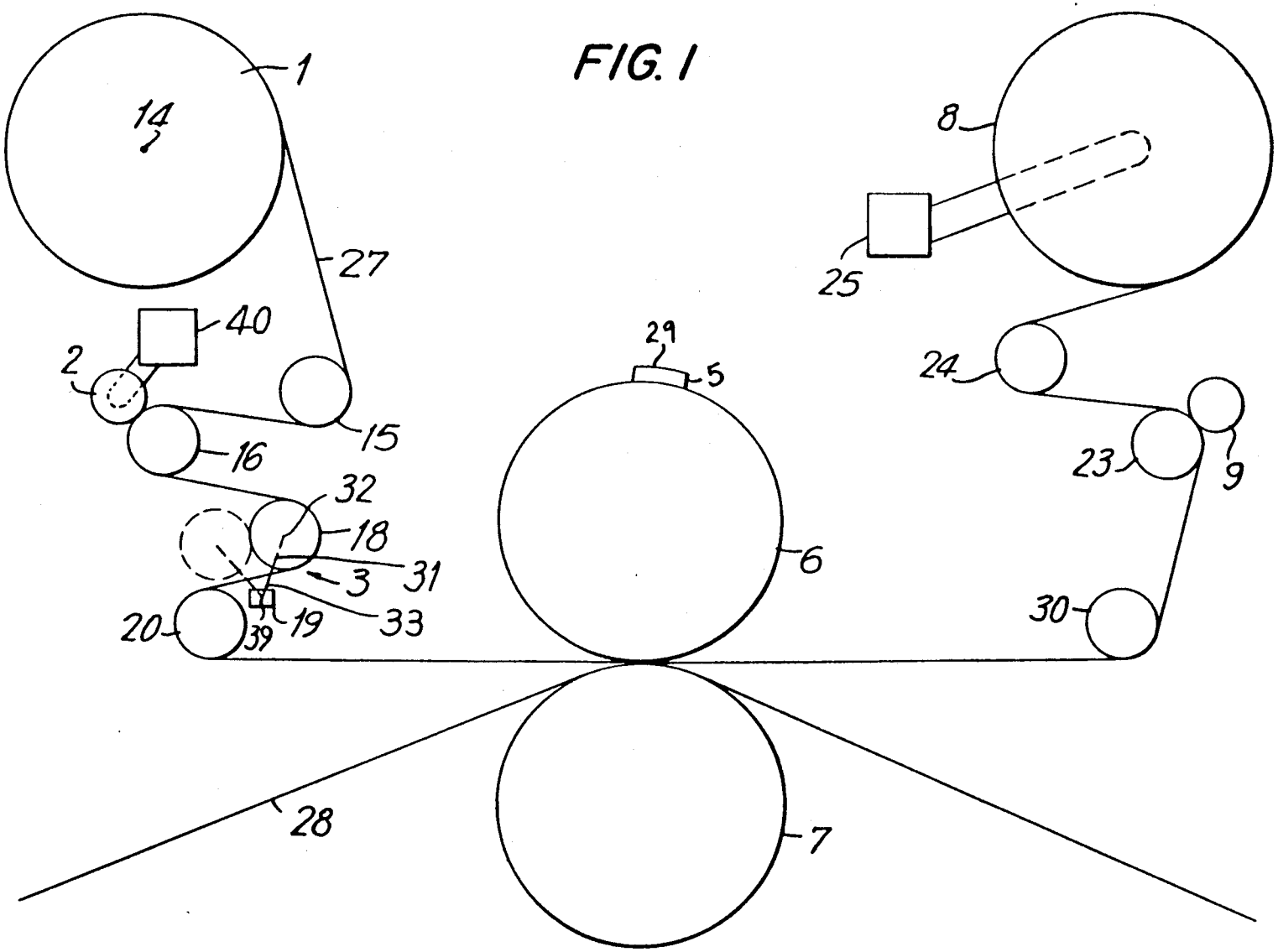
FIG. 1 is a frontal view of a segment of a rotary stamping machine in accordance with an embodiment of the present invention.

As shown in FIG. 1, an illustrative embodiment of an improved rotary stamper comprises rotatable die roller 6 which is positioned above rotatable back-up roller 7 such that metal leaf 27 and substrate web 28, which are arranged in superposition with respect to one another, can be moved between die roller 6 and back-up roller 7. On the circumference of die roller 6 is affixed at least one raised die 5, having selected design 29 on its surface. Raised die 5 is positioned such that when it is rotated it contacts the metal leaf and urges metal leaf 27 against substrate web 28 and back-up roller 7 to transfer the design contained on raised die 5 onto substrate web 28.

The distance between the die roller and the back-up roller is determined by the thickness of metal leaf 27 and substrate web 28. The distance may not allow raised die 5 to penetrate more than about 0.0005 of an inch into substrate web 28 when raised die 5 and back-up roller 7 are at the position where they are closest to one another.

Die roller 6 rotates with a velocity $V_1$ substantially equal to the velocity of the substrate web. The velocity of the substrate web is substantially greater than a velocity $V_2$ of the metal leaf 27 which is its velocity immediately upstream from die roller 6 when not in contact with raised die 5. When raised die 5 rotates into contact with metal leaf 27, the frictional force of raised die 5 on metal leaf 27 causes metal leaf 27 to accelerate so that when the point on metal leaf 27 where raised die 5 contacts metal leaf 27 reaches the stamping location, the point where transfer of the design contained on raised die 5 occurs, metal leaf 27 is traveling at velocity $V_1$, substantially the same as the velocity of the substrate web. It is essential that metal leaf 27 and substrate web 28 be traveling at substantially the same velocity at the point where the design is transferred.

After raised die 5 rotates out of contact with metal leaf 27, metal leaf 27 decelerates to velocity $V_2$ by the action of a first means for feeding. During deceleration, the instantaneous velocity of metal leaf 27 may be negative.

The first means for feeding also acts to absorb forces exerted on metal leaf 27 during acceleration and deceleration.

In a preferred embodiment, the first means for feeding may be low inertia dancer 3, which is movable between two positions. The first position allows a greater distance of travel from feed roller 1 to die roller 6. The second position allows a lesser distance of travel from feed roller 1 to die roller 6.

Low inertia dancer 3 contains a means for maintaining 19 which holds roller 18 in the first position except when metal leaf 27 is accelerated to $V_1$, which force causes roller 18 to move low inertia dancer 3 to the second position. When the force of acceleration is removed, a force of 5 pounds per inch of width of metal leaf 27 is exerted by the means for retention 19 causing roller 18 to return to the first position.

Low inertia dancer 3 has the effect of minimizing breakage of metal leaf 27 by absorbing the transient forces applied to metal leaf 27 when it is accelerated to a velocity $V_1$. Without low inertia dancer 3, the force of the acceleration would be translated to a single point on metal leaf 27. Application of this force to a single point would likely result in frequent breaking of and damage to the metal leaf and in some cases the carrier substrate. In practice, it has been found that about five pounds per inch of metal leaf width is necessary to move retention device 19.

Referring to FIG. 1, from roller 18 of low inertia dancer 3, metal leaf 27 travels over rotatable capstan 20 and then between die roller 6 and back-up roller 7 where a selected design contained on raised die 5 is transferred from metal leaf 27 onto substrate web 28 as described above.

Prior to stamping, metal leaf 27, which is made up of a carrier, a release layer and a metalized layer, is stored on feed roller 1 which is rotatable around axle 14. A suitable metal leaf is available from Pyramid Roll Leaf, P.O. Box 116, Peguannock, New Jersey 07440, under the Model No. PYRAMID XH 604 RT35. Metal leaf 27 is fed off of a feed roller 1 at a velocity $V_3$, which is preferably equal to the average velocity of metal leaf 27 at a point just upstream from the die roller and is related to velocity $V_1$. Metal leaf 27 then travels over rotatable capstan 15 and then around rotatable capstan 16. Abutting capstan 16 is rotatable pinch roller 2 which is rotated by a second means for feeding 40. Second means for feeding rotates pinch roller 2 to drive metal leaf 27 at velocity $V_3$ which is maintained substantially constant notwithstanding any acceleration of metal leaf 27.

The force applied by pinch roller 2 to capstan 16 to drive metal leaf 27 is not fixed and will be known by those skilled in the art. Such force may be adjusted in the course of continuous operation as external factors such as, for example, the temperature of pinch roller 2 and metal leaf 27 affect the amount of force necessary to drive metal leaf 27. Those skilled in the art will understand this and other factors which can affect pinch roller 2 as well as pinch roller 9 and may adjust the forces applied between pinch rollers 2 and 9 and capstans 16 and 23 appropriately.

After metal leaf 27 moves away from die roller 6, it travels over rotatable capstan 30 and between rotatable capstan 23 and rotatable pinch roller 9. Metal leaf 27 then travels over rotatable capstan 24 and onto rotatable take-up roller 8. Take-up roller 8 is rotated by means for taking up 25 which rotates the take-up roller at velocity $V_3$.

In a preferred embodiment, die roller 6 may contain a plurality of spaced raised dies located at different positions along and about the die roller (not shown). Such spacing may be even or uneven. Where the spacing is uneven it allows a pattern of unevenly spaced stamps to be made on the substrate web. This is important in the packaging industry where, in order to make efficient use of the substrate, the intended positions for printing patterns and stamps are not uniform on the substrate web. Even in these applications, however, the printing patterns and stamps are intended to follow a complex pattern that is repeated.

In another preferred embodiment of the invention, substrate web 28 has a velocity $V_1$ of between 300-500 feet per minute and velocity $V_2$ of metal leaf 27 is approximately 10% of velocity $V_1$.

In another preferred embodiment, low inertia dancer 3 includes a roller 18 rotatably attached to arm 31 at end 32. Arm 31 is rotatable at end 33 around pivot 39. In another embodiment, means of maintaining 19 is a spring connected between arm 31 and pivot 39.

Figure 2:
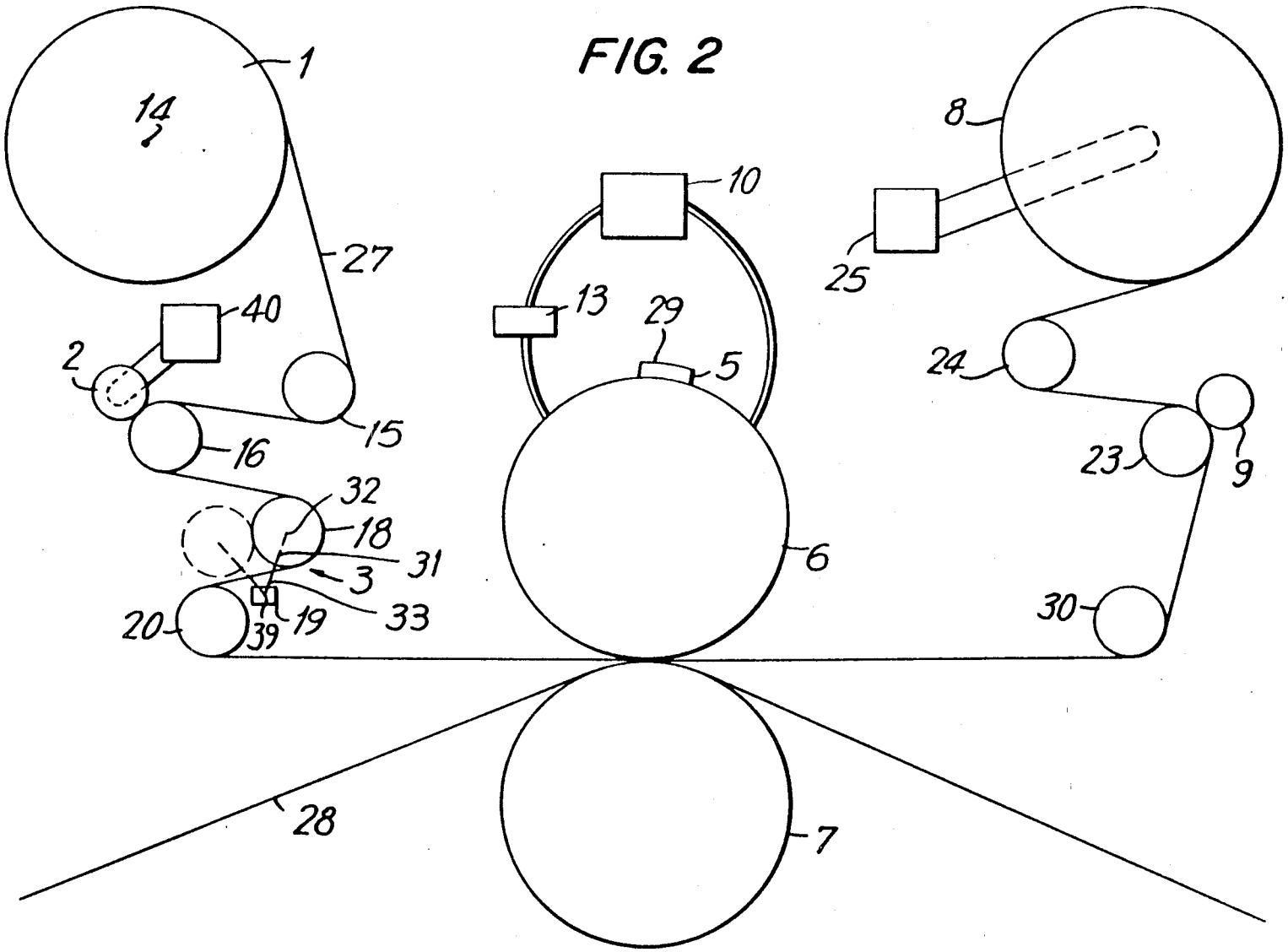
FIG. 2 is a is a frontal view of a segment of a rotary stamping machine in accordance with another embodiment of the present invention.

Referring to FIG. 2, in a preferred embodiment of the invention, die roller 6 is heated to improve the quality of the transfer of the metal leaf to the substrate, usually paper stock or thermoplastic webs. The heat also allows use of metal leaf 27 which contains a heat sensitive adhesive. Preferably, die roller 6 is hollow and is heated by circulating oil maintained at a desired temperature through hollow die roller 6. This oil can be supplied from reservoir 10 where it is heated and circulated through die roller 6 by means of oil pump 13. Other methods of heating could be used.

Figure 3:
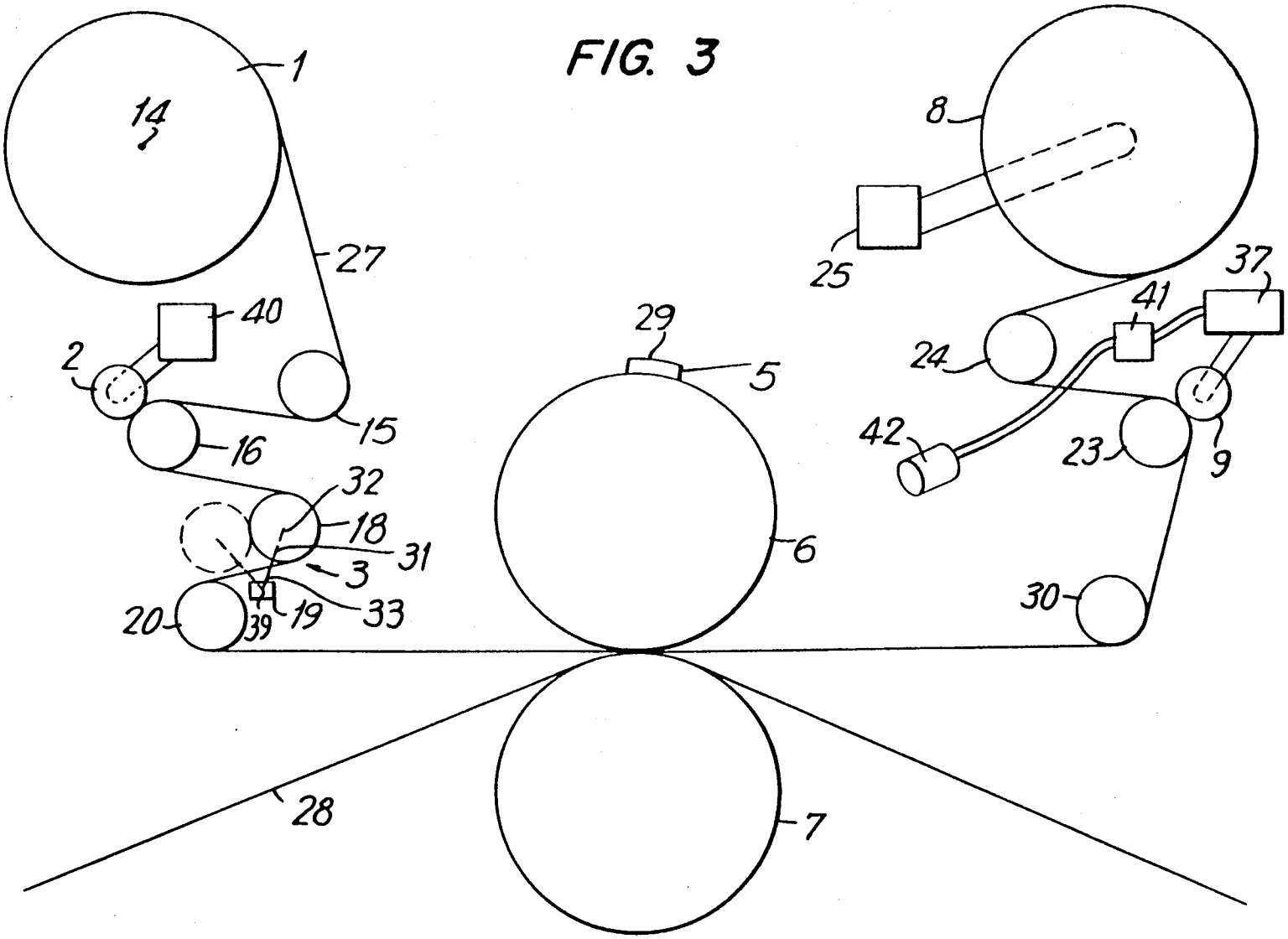
FIG. 3 is a is a frontal view of a segment of a rotary stamping machine in accordance with another embodiment of the present invention.

Referring to FIG. 3, in another preferred embodiment, pinch roller 9 is rotated by means for accelerating and decelerating pinch roller 37 and thereby metal leaf 27 between velocity $V_1$ and velocity $V_2$. This acceleration is begun just before raised die 6 rotates into contact with metal leaf 27. Deceleration begins when raised die 5 rotates out of contact with metal leaf 27 and is stopped when velocity $V_2$ is achieved. When metal leaf is traveling at velocity $V_2$ pinch roller 9 is freely rotatable.

Figure 6:
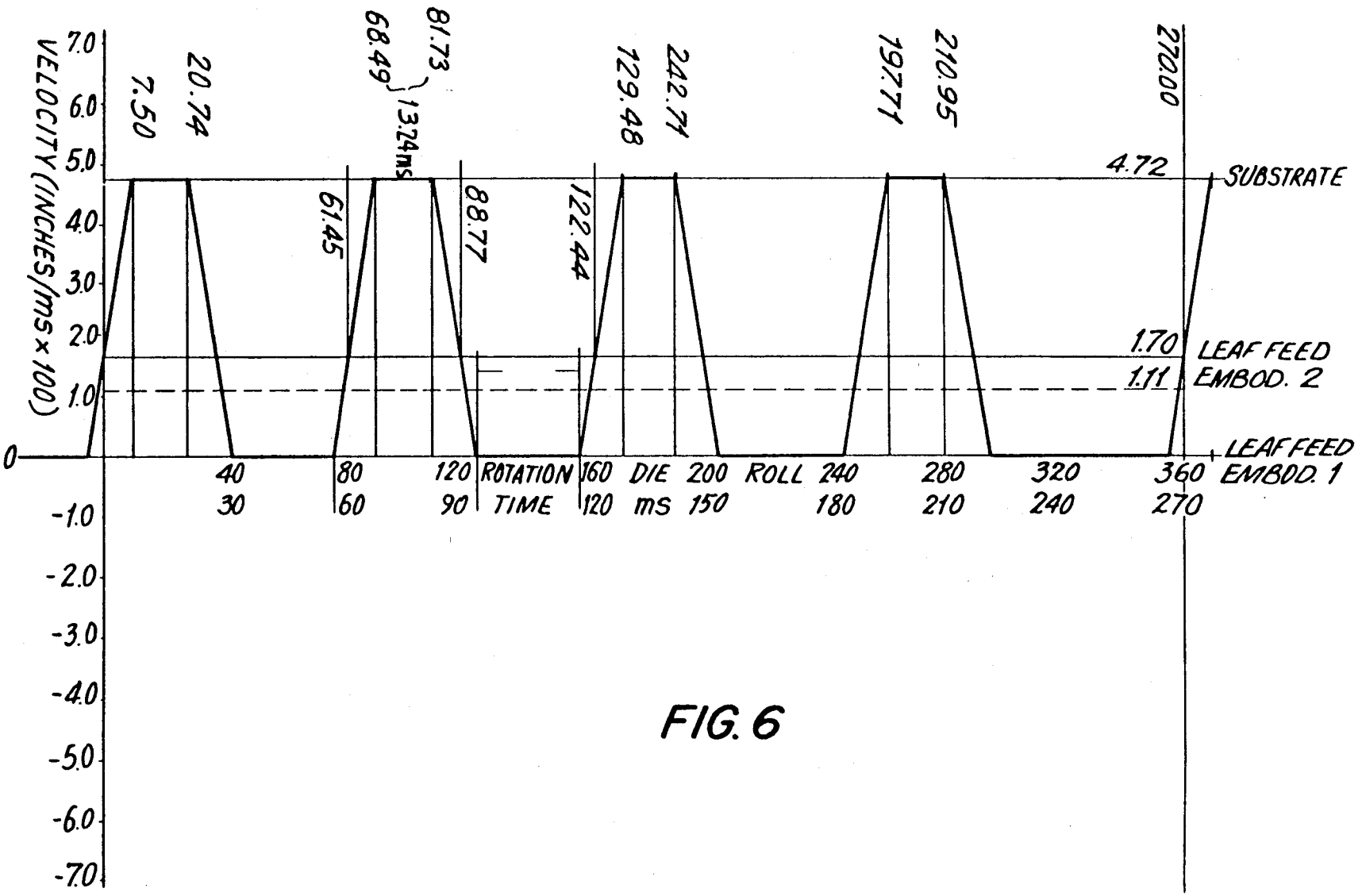
FIG. 6 is a timing graph showing the velocity of the metal leaf relative to the angular position of the die roller in accordance with another embodiment of the present invention.

In a more preferred embodiment, an electrical circuit includes a programmable microprocessor 41 and a means for detecting the angular position of raised die 42 relative to contact with metal leaf 27 which controls the means for accelerating and decelerating of pinch roller 37 in relation to the position of raised die 5 and in accordance with the timing graph described in FIG. 6. When raised die 5 is about to rotate into contact with the metal leaf 27, at 80 degrees, for example, the electrical circuit signals a servo motor (not shown) to accelerate pinch roller 9. When raised die 5 rotates out of contact with metal leaf 27 at 106.6 degrees, for example, the electrical circuit signals the servo motor to decelerate pinch roller 9 to rest.

Figure 4:
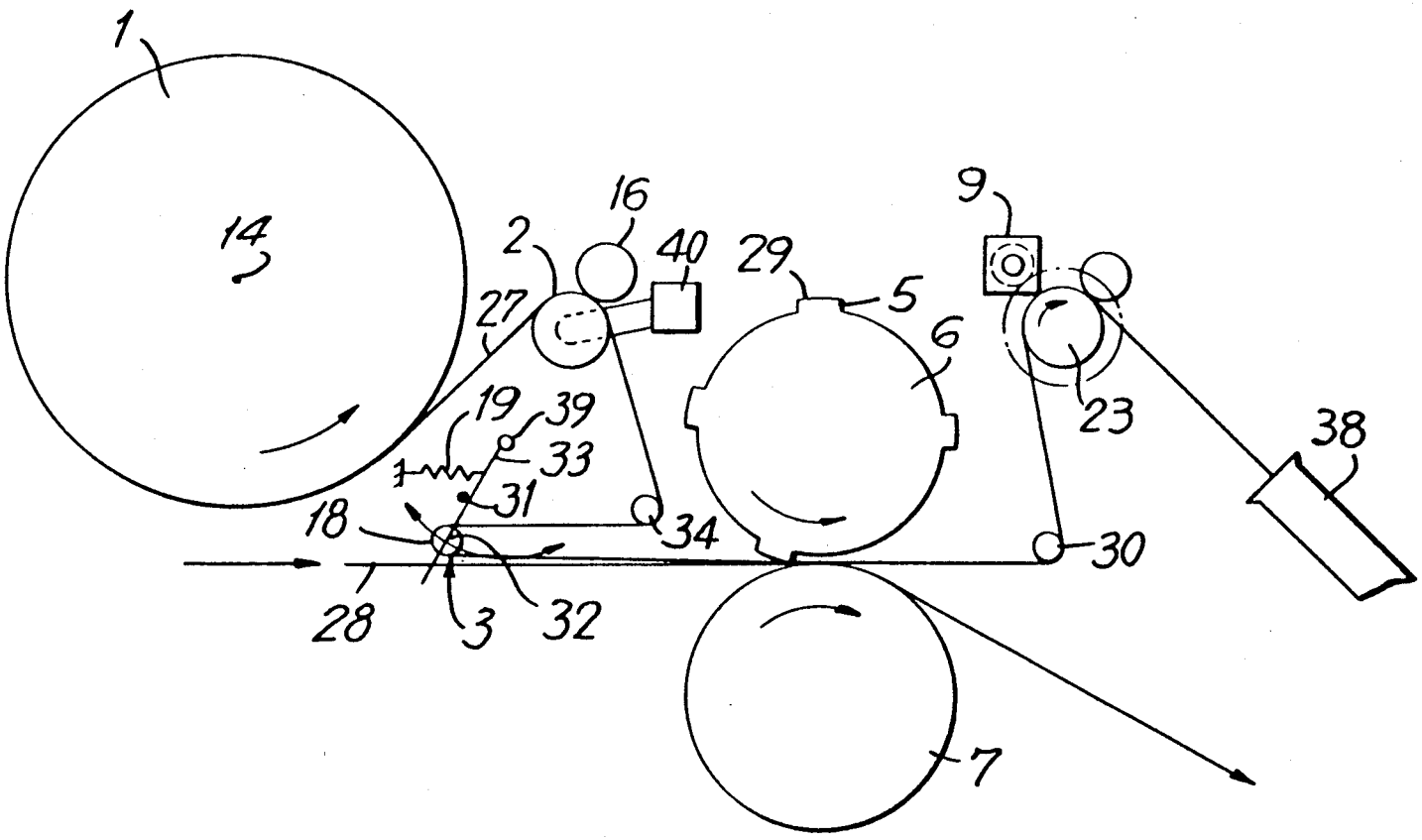
FIG. 4 is a frontal view of a segment of a rotary stamping machine in accordance with another embodiment of the present invention.

Referring to FIG. 4, in another preferred embodiment, metal leaf 27 travels from rotatable feed roll 1 over rotatable pinch roller 2 which is rotated by second means for feeding 40 at substantially constant Velocity $V_3$.

Figure 5:
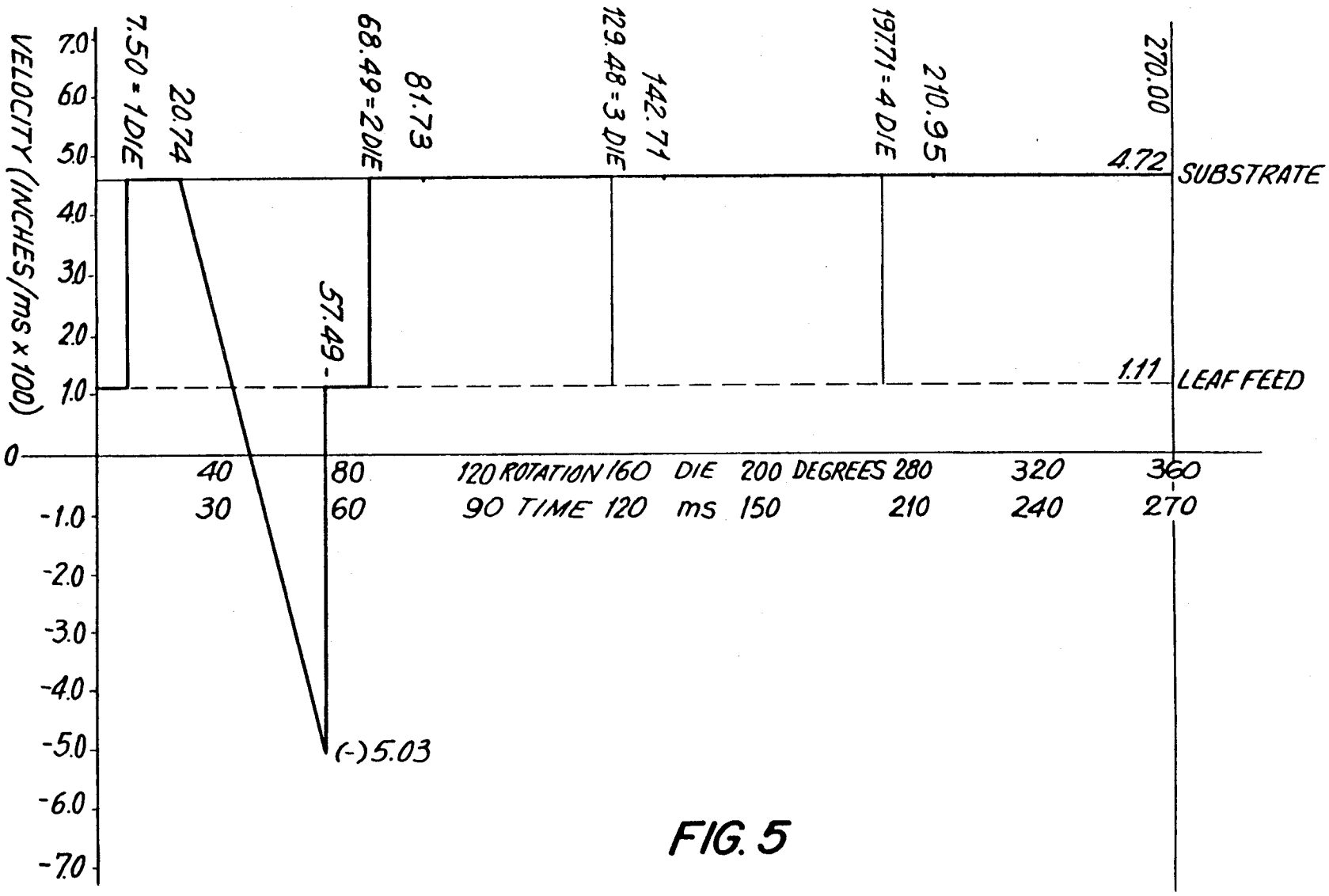
FIG. 5 is a timing graph showing the velocity of the metal leaf relative to the angular position of the die roller in accordance with an embodiment of the present invention.

After passing pinch roller 2, metal leaf 27 travels over capstan 34 and roller 18 of low inertia dancer 3. Low inertia dancer 3 is retained by means for retaining 19, preferably a spring. In this embodiment, low inertia dancer 3 is inverted from the embodiments illustrated in FIG. 1. After metal leaf 27 goes between die roller 6 and back-up roller 7, it travels over capstan 30 and between pinch roller 9. After metal leaf 27 travels over pinch roller 9, it is taken up by suction tube 38. In accordance with the timing graph described in FIG. 5, when raised die 5 rotates into contact with metal leaf 27 it accelerates metal leaf 27 to Velocity $V_1$. When raised die 5 rotates out of contact with metal leaf 27, low inertia dancer 3 acts to decelerate metal leaf 27 to velocity $V_2$. When low inertia dancer 3 has reached its motion limit, metal leaf 27 is accelerated to Velocity $V_3$.

Figure 7:
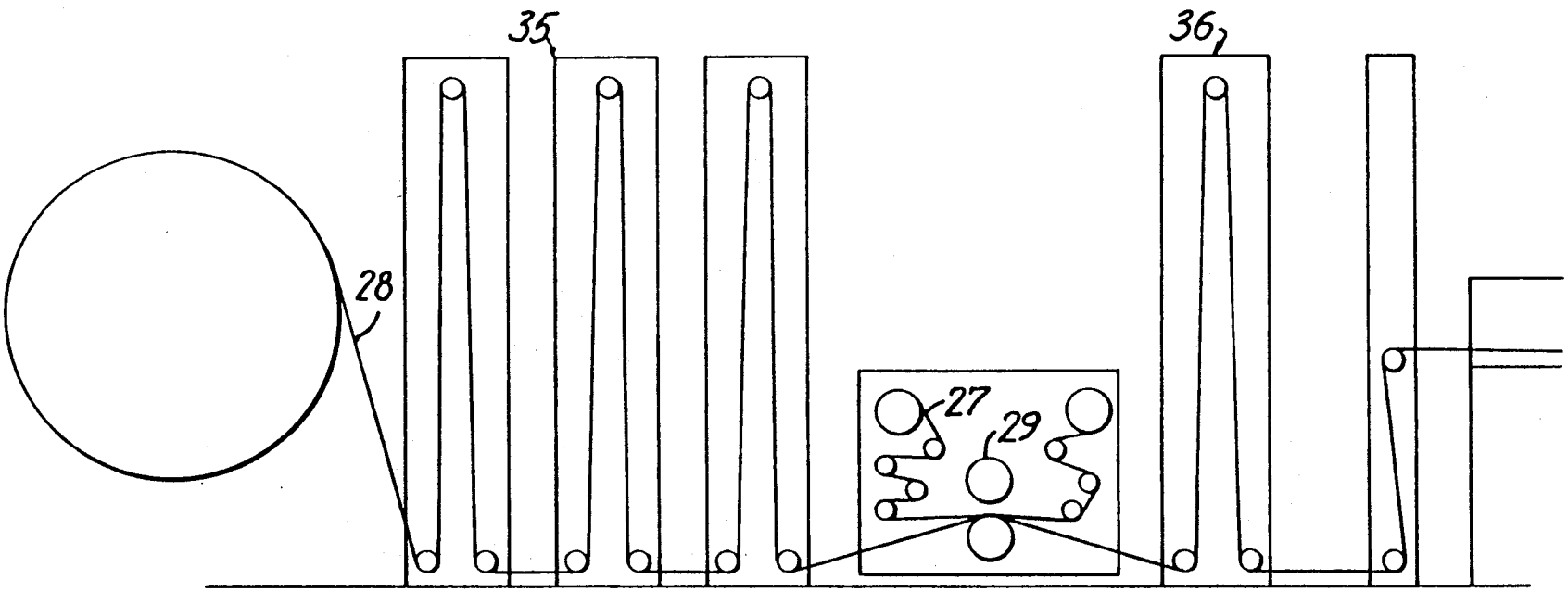
FIG. 7 is a frontal view of an in-line gravure printing machine in accordance with another embodiment of the present invention.

Referring to FIG. 7, in a preferred embodiment, the apparatus and methods of the present invention may be incorporated into, for example, an apparatus or method for in-line gravure ink printing. Advantageously this allows for printing a substrate with a first pattern at a series of printing stations 35, stamping design 29 from metal leaf 27 onto the same substrate without losing line speed and printing with a second pattern at a subsequent print station 36 to yield finished package blanks while minimizing wastage of metal leaf and reducing the amount of breakage of the metal leaf.

Thus a rotary stamper and method for its use is provided which can vary the velocity of a metal leaf. One skilled in the art will appreciate that the present invention can be practiced by other than the described embodiments, which are presented for purposes of illustration and not of limitation, and the present invention is limited only by the claims which follow.

I claim:

1. An apparatus for stamping metal leaf designs from a continuous sheet of metal leaf onto a continuous sheet of substrate web moving in the same direction as the metal leaf at a first velocity at a stamping location, comprising:

a die roller having a raised die including a design;

a back-up roller mounted in opposition to the die roller so that the metal leaf and substrate web may be passed between the die roller and the back-up roller and sot hat the raised die will contact and urge the metal leaf against the substrate web and the back-up roller, thereby to transfer metal leaf in the design to the substrate;

first means for feeding the metal leaf between the die roller and the back-up roller at a variable velocity between a second velocity and the first velocity having an average velocity equal to the third velocity, the second velocity being slower than the first velocity; and means for rotating the die roller and the back-up roller at the first velocity so that the contact between the raised die and the metal leaf accelerates the metal leaf from the second velocity to the first velocity as the metal leaf is urged against the substrate.

2. The apparatus of claim 1, further comprising second means for feeding the metal leaf at the third velocity to the first means for feeding and wherein the first means for feeding further comprises a low inertia dancer in communication with the metal leaf and the dancer being disposed between said second means and said die and backup rollers and having a first position for providing the metal leaf a first distance of travel from the second means for feeding to the die roller and a second position for providing the metal leaf a second distance of travel from the second means for feeding to the die roller, the first distance being greater than the second distance, said dancer being adapted for moving from said first position to said second position during acceleration of the metal leaf from the second velocity to the first velocity, thereby to absorb forces exerted on the metal leaf during acceleration and for moving from said second position to said first position after the raised die moves out of contact with the roller thereby to decelerate the metal leaf from the first velocity to the second velocity.

3. The apparatus of claim 1, wherein the die roller contains a plurality of unevenly spaced raised dies.

4. The apparatus of claim 1, wherein the die roller contains a plurality of evenly spaced raised dies.

5. The apparatus of claim 1, further comprising means for accelerating and decelerating the metal leaf between the first velocity and the second velocity, said means accelerating the metal leaf from the second velocity just before the raised die contacts the metal leaf and decelerating the metal leaf from the first velocity when the raised die moves out of contact with the metal leaf, said means being located downstream from the second means for feeding.

6. The apparatus of claim 5, wherein the means for accelerating and decelerating the metal leaf comprises:

a pinch roller and associated capstan disposed on opposite sides of the metal leaf; and means for rotating the pinch roller to accelerate and decelerate the pinch roller between the first velocity and the second velocity.

7. The apparatus of claim 5, further comprising:

means for detecting the angular position of the raised die relative to contact with the metal leaf; and microprocessor means for controlling the means for accelerating and decelerating in response to the detected angular position.

8. The apparatus of claim 2, wherein the die roller is heated.

9. The apparatus of claim 8, wherein the die roller is heated by circulating hot oil through the die roller.

10. The further apparatus of claim 2, wherein the low inertia dancer comprises:

a pivot;

a roller for contacting the metal leaf;

an arm having a first end and a second end, the first end being rotatably connected to the pivot and the second end being connected to the roller; and means for maintaining the roller in contact with the metal leaf when the dancer is in the first and second positions and moving therebetween.

11. The apparatus of claim 10, wherein the means for maintaining is a spring.

12. The apparatus of claim 2, further comprising means for accelerating and decelerating the metal leaf between the first velocity and the second velocity, said means accelerating the metal leaf from the second velocity just before the raised die contacts the metal leaf and decelerating the metal leaf from the first velocity when the raised die moves out of contact with the metal leaf, said means being located downstream from the second means for feeding.

13. The apparatus of claim 12, wherein the means for accelerating and decelerating the metal leaf comprises:

a pinch roller and associated capstan disposed on opposite sides of the metal leaf; and means for rotating the pinch roller to accelerate and decelerate the pinch roller between the first velocity and the second velocity.

14. The apparatus of claim 12, further comprising:

means for detecting the angular position of the raised die relative to contact with the metal leaf; and microprocessor means for controlling the means for accelerating and decelerating in response to the detected angular position.

15. A method for stamping metal leaf designs from a continuous sheet of metal leaf onto a continuous sheet of substrate at a stamping location, comprising:

passing the substrate at a first velocity in a first direction between a back-up roller and a die roller having a raised die including a design thereon;

passing the metal leaf moving at a second velocity in the same direction as the substrate, in superposition to the substrate and between the die roller and back-up roller, said first velocity being faster than said second velocity;

rotating the back-up roller and the die roller at the first velocity;

accelerating the metal leaf from the second velocity to the first velocity by contacting the metal leaf with the rotating raised die;

absorbing the forces exerted on the metal leaf during acceleration of the metal leaf; and urging the raised die in contact with the metal leaf against the substrate web and the back-up roller to stamp the design onto the substrate at the stamping location.

16. The method of claim 15, wherein absorbing the forces further comprises providing a lower inertia dancer including a movable roller having a first position for providing the metal leaf a first distance of travel from a second means for feeding to the die roller and a second position for providing the metal leaf a second distance of travel from the second means for feeding to the die roller, the first distance being greater than the second distance, said dancer being adapted for moving from the first position to the second position.

17. The method of claim 15, wherein stamping the design onto the substrate occurs in an unevenly spaced repeating pattern.

18. The method of claim 15, wherein stamping the design onto the substrate occurs in an evenly spaced repeating pattern.

19. The method of claim 15, wherein the second velocity is approximately 10% of the first velocity.

20. The method of claim 16, wherein the first velocity is in a range of from about 300 to about 500 feet per minute.

21. The method of claim 15, further comprises heating the raised die.

22. The method of claim 18, wherein heating the raised die is accomplished by the circulation of hot oil.

23. The method of claim 15, further comprising providing a low inertia dancer capable of absorbing the forces exerted on the metal leaf after repeated stamping.

24. The method of claim 15, wherein accelerating the metal leaf from the first velocity to the second velocity further comprises:

accelerating the metal leaf from the second velocity to about the first velocity prior to contacting the metal leaf with the raised die; and decelerating the metal leaf from the first velocity to second velocity after the raised die moves away from the metal leaf.

* * * * *